United States Patent [19]

Cearley

[11] Patent Number: 5,074,173

[45] Date of Patent: Dec. 24, 1991

[54] SPARK PLUG TOOL

[76] Inventor: C. Dewayne Cearley, Rt. 2 Box 263-4, Springtown, Tex. 76082

[21] Appl. No.: 590,217

[22] Filed: Sep. 28, 1990

[51] Int. Cl.[5] ..... B25B 23/16

[52] U.S. Cl. ..... 81/177.6; 81/125; 81/177.85

[58] Field of Search ..... 81/124.6, 125, 177.1, 81/177.6, 177.85

[56] References Cited

U.S. PATENT DOCUMENTS

| | | | |
|---|---|---|---|
| 1,449,358 | 3/1923 | Weber . | |
| 2,511,049 | 6/1950 | Coldwell . | |
| 2,701,491 | 2/1955 | Ross . | |
| 2,814,322 | 11/1957 | Kupfrian . | |
| 2,947,564 | 8/1960 | Winther | 81/177.6 X |
| 2,956,462 | 10/1960 | Paul | 81/125 |
| 3,322,007 | 5/1967 | Cunningham . | |
| 3,397,602 | 8/1968 | Estep et al. . | |
| 3,579,677 | 5/1971 | Ullman . | |

FOREIGN PATENT DOCUMENTS

| | | | |
|---|---|---|---|
| 1043735 | 11/1953 | France | 81/177.6 |
| 1043736 | 11/1953 | France | 81/125 |

*Primary Examiner*—James G. Smith

*Attorney, Agent, or Firm*—James E. Bradley

[57] ABSTRACT

A spark plug tool for installing a spark plug utilizes a flexible shaft. The flexible shaft secures to a tubular housing on one end. A handle locates on the other end of the flexible shaft. The tubular housing has internal polygonal sides formed in it for mating with polygonal sides of a spark plug. A resilient liner located in the housing grips the insulation sheath of the spark plug to retain the spark plug with the housing. The shaft can be detached from the housing after it has been used to initially tighten the spark plug. A square hole formed in the upper end of the housing will receive a conventional socket torque tool.

6 Claims, 1 Drawing Sheet

SPARK PLUG TOOL

BACKGROUND OF THE INVENTION

1. Field of the Invention

This invention relates in general to tools for working on motor vehicles, and in particular to a spark plug tool for installing a spark plug in an engine.

2. Description of the Prior Art

Gasoline powered internal combustion engines for motor vehicles utilize a spark plug for each piston and cylinder. The engine compartment of a modern vehicle often is crowded because of power assist, pollution control and air conditioning equipment. Often, the spark plugs are concealed from view and difficult to reach.

This can be particularly a problem when attempting to thread the spark plug threads into a threaded hole in the engine. Socket wrenches are currently used, but it is difficult to start the threads with a socket wrench, when the threaded hole is not visible and conditions are crowded. Users often insert a spark plug by hand and thread it hand tight. Then the user will insert a socket type spark plug wrench over the spark plug to fully tighten the spark plug. Sometimes, the user cannot reach the position that he needs in order to thread the spark plug in by hand. Inserting the spark plug into the socket, then using an extension member to try to insert the spark plug into the threaded hole is also not easy.

SUMMARY OF THE INVENTION

In this invention, a tool is provided for installing a spark plug in a spark plug hole. The tool has a tubular housing with internal polygonal sides. These internal sides mate with the polygonal sides of the spark plug. A resilient liner located in the housing frictionally grips the insulation sheath of the spark plug.

A flexible shaft secures to the tubular housing. The shaft has a handle on its upper end. Preferably, the shaft can be detached from the housing. The housing has a polygonal hole at its upper end for receiving a conventional socket drive head of a socket wrench or torque tool once the flexible shaft has been detached.

DETAILED DESCRIPTION OF THE INVENTION

Figure 1:
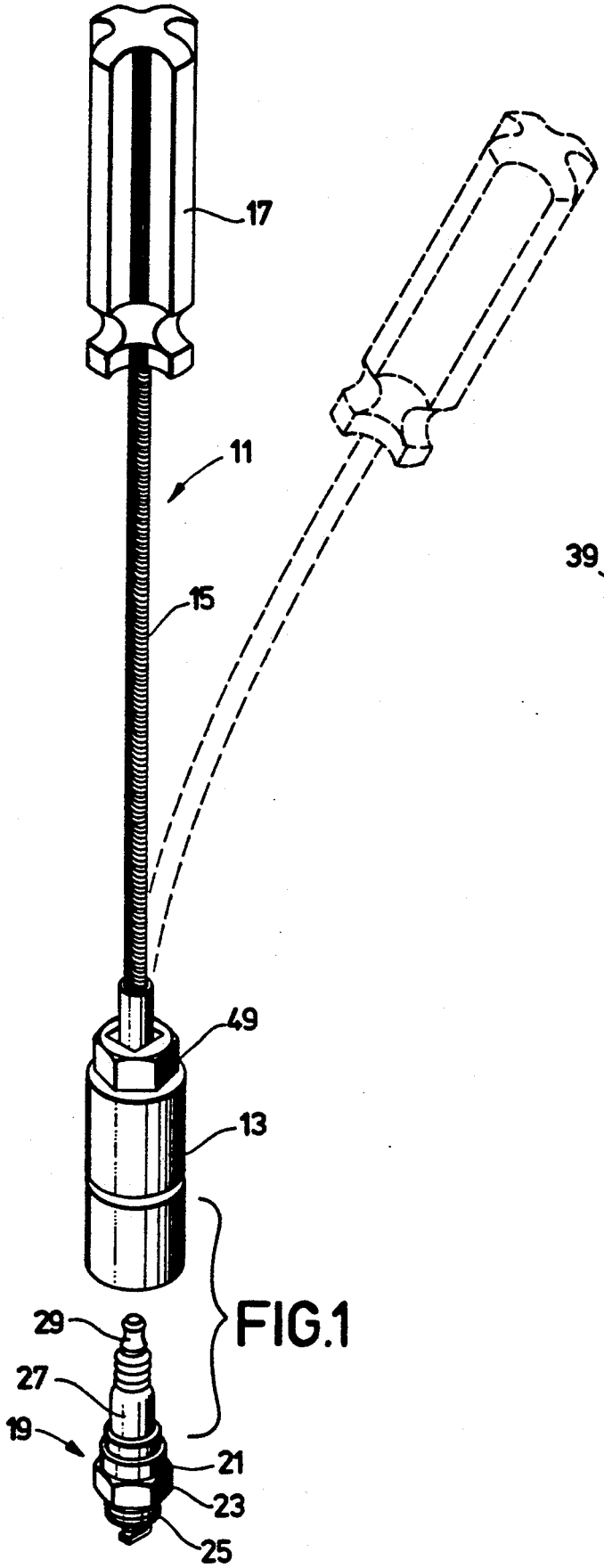
FIG. 1 is a perspective view illustrating a spark plug tool constructed in accordance with this invention.

Referring to FIG. 1, spark plug tool 11 has a housing 13, a flexible shaft 15, and a handle 17 secured to the upper end of the flexible shaft 15. The flexible shaft 15 is a tightly wound wire coil which provides substantial resiliency in bending, as shown by the dotted lines in FIG. 1. Handle 17 is also conventional, and of a type that might be used on a screwdriver. It is configured for grasping by the hand of a user.

The spark plug tool 11 is constructed for installing a conventional spark plug 19. Spark plug 19 has a metal body 21. Body 21 has flat polygonal external sides 23, normally six. Threads 25 extend below the polygonal sides 23. An insulation sheath 27 of a hard material such as ceramic extends upward from the metal body 21. A metal tip 29 protrudes upward from the insulation sheath 27.

Figure 2:
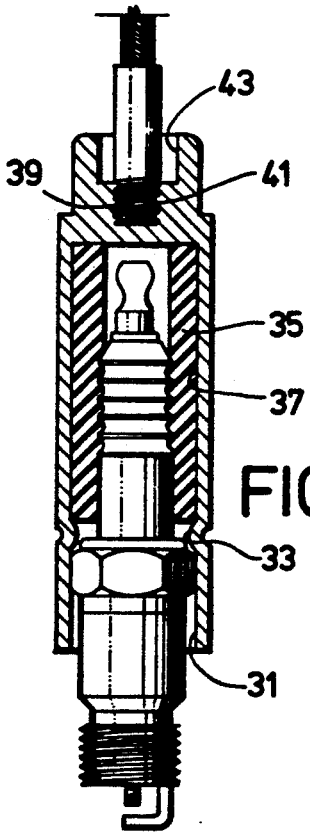
FIG. 2 is a vertical sectional view of a portion of the spark plug tool of FIG. 1.
Figure 3:
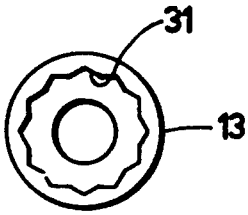
FIG. 3 is a bottom view of the spark plug tool of FIG. 1.

Referring to FIGS. 2 and 3, the tool housing 13 has on its lower end internal polygonal sides 31. The sides 31 are configured so that they will closely receive and engage the polygonal sides 23 of the spark plug 19. The sides 31 have a configuration of a conventional socket for applying torque for tightening the spark plug 19 through the polygonal sides 23. There are more sides of the internal side section 31 than the external sides 23 of the spark plug 19. However, the internal side section 31 receives the corners of the external sides 23 to apply torque.

An internal shoulder 33 provides an upper limit into which the spark plug sides 23 can insert. The inner diameter of the shoulder 33 is smaller than the outer diameter of the polygonal sides 23, preventing any further upward travel of the spark plug 19 once the spark plug 19 reaches the position shown in FIG. 2.

An elastomeric liner 35 is secured in a cylindrical cavity 37 in the housing 13 above the shoulder 33. Liner 35 is of a rubber or other type of elastomeric material. It is fairly soft and resilient. Liner 35 is tubular, having an inner diameter that is less than the outer diameter of the spark plug sheath 27. Consequently, when the spark plug 19 inserts into the housing 13, the liner 35 will frictionally grip the insulation sheath 27. The inner diameter of the elastomeric liner 35 is substantially greater than the tip 29, as shown in FIG. 2.

The cavity 37 is open at its lower end for receiving spark plug 19, but closed at its upper end. An upper threaded hole 39 is formed in the upper end of the housing 13 above the cavity 37. The flexible shaft 15 has a threaded end 41 located on its lower end. The end 41 secures in the threaded hole 39. The threaded end 41 serves as a securing means for releasably securing the flexible shaft 15 to the housing 13.

A square hole 43 is formed in the upper end of the housing 13 above the threaded hole 39. The square hole 43 has four flat sides and is greater in transverse dimension than the diameter of the threaded hole 39. The threaded end 41 of the flexible shaft 15 inserts through the square hole 43 for engaging the threaded hole 39.

Figure 4:
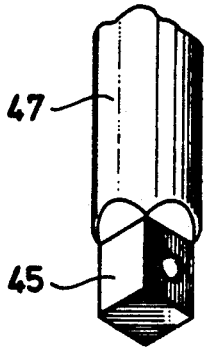
FIG. 4 is a view of a portion of the bottom of a conventional drive head of a socket wrench torque tool.

Once the flexible shaft threaded end 41 is unscrewed from the housing 13, the square hole 43 will receive a conventional drive head 45 of a socket wrench torque tool 47 (FIG. 4). The drive head 45 is square for inserting into the square hole 43.

The housing 13 has a set of wrench flats 49 formed on the exterior of the housing 13 at the upper end. Wrench flats 49 comprises six flat sides and are of a conventional size for receiving an open end or box end wrench (not shown).

In operation, the user will secure the housing 13 to the flexible shaft 15 by rotating the shaft 15 and housing 13 relative to each other to screw the threaded end 41 into the threaded hole 39. The user inserts the spark plug 19 into the housing 13. The liner 35 will frictionally grip the sheath 27. The spark plug sides 23 will mate with the polygonal sides 31 of the housing 13.

The user then places the threads 25 of the spark plug 19 in the hole (not shown) in the engine. The user likely will need to flex the shaft 15 during this movement. The user will grip the handle 17 and rotate the housing 13 until the spark plug 19 engages the threads within the engine hole and tightens to an initial tightness. This initial tightness will be only that which the user can achieve with his hand gripping the handle 17.

Then, the user may use a open end wrench to engage the wrench flats 49 and tighten the spark plug 19 to the final tightness. He may leave the flexible shaft 15 attached if an open end wrench is used. Also, he may detach the flexible shaft 15 and use either a box end wrench or a socket torque tool 47. To detach the flexible shaft 15 while keeping the housing 13 on the spark plug 19, the user will rotate the handle 17 in the opposite direction while holding the housing 13 with his fingers, if necessary. This causes the threaded end 41 to unscrew from the housing 13. Once the shaft 15 has been removed, the user then inserts the drive head 45 into the hole 43 in the upper end of housing 13. He uses conventional driving equipment to drive the torque tool 47 to fully tighten the spark plug 19 in the engine hole.

The invention has significant advantages. The spark plug wrench easily enables the user to insert the spark plug into the engine hole. The spark plug can then be fully tightened using a conventional driving head of a torque tool.

While the invention has been shown in only one of its forms, it should be apparent to those skilled in the art that it is not so limited, but is susceptible to various changes without departing from the scope of the invention.

I claim:

1. A tool for installing a spark plug in a spark plug hole in an engine, the spark plug having a metal body with polygonal sides and a set of threads, a hard insulation sheath and a tip protruding from the sheath, the tool comprising in combination:

a tubular housing having a lower end and an upper end;

internal polygonal sides formed in the lower end of the housing for engaging the polygonal sides of the spark plug;

an elastomeric liner located sin the housing above the internal polygonal sides, the liner having a smaller inner diameter than the outer diameter of the insulation sheath and a larger inner diameter than the tip for frictionally receiving the insulation sheath of the spark plug, to releasably retain the spark plug in the housing;

a flexible shaft having an upper end and a lower end;

a handle secured to the upper end of the shaft;

securing means for securing the lower end of the shaft to the housing, enabling a user to grasp the handle, insert the spark plug into the housing, insert the spark plug in the spark plug hole and rotate the spark plug with the handle to screw the spark plug into the spark plug hole; and wherein the securing means comprises:

a threaded member joined to the lower end of the shaft; and internal threads formed in the housing for receiving the threaded member, allowing the shaft to be detached from the housing by unscrewing the threaded member from the internal threads after the user has tightened the spark plug initially with the handle; and wherein the tool further comprises:

a hole with polygonal sides formed in the upper end of the housing above the internal threads for receiving a torque member for rotating the housing to fully tighten the spark plug in the engine after the flexible shaft has been detached from the housing.

2. A tool for installing a spark plug in a spark plug hole in an engine, the spark plug having a metal body with polygonal sides and a set of threads, a hard insulation sheath and a tip protruding from the sheath, the tool comprising in combination:

a tubular housing having a lower end and an upper end;

internal polygonal sides formed in the lower end of the housing for engaging the polygonal sides of the spark plug;

an elastomeric liner located in the housing above the internal polygonal sides, the liner having a smaller inner diameter than the outer diameter of the insulation sheath and a larger inner diameter than the tip for frictionally receiving the insulation sheath of the spark plug, to releasably retain the spark plug in the housing;

a flexible shaft having an upper end and a lower end;

a handle secured to the upper end of the shaft;

securing means for securing the lower end of the shaft to the housing, enabling a user to grasp the handle, insert the spark plug into the housing, insert the spark plug in the spark plug hole and rotate the spark plug with the handle to screw the spark plug into the spark plug hole;

wherein the securing means releasably secures the flexible shaft to the housing to enable the flexible shaft to be detached from the housing once the handle has initially tightened the spark plug; and wherein the tool further comprises:

a hole with polygonal sides formed in the upper end of the housing above the internal threads for receiving a torque member after the flexible shaft has been detached from the housing for rotating the housing to fully tighten the spark plug in the engine.

3. A tool for installing a spark plug in a spark plug hole in an engine, the spark plug having a metal body with polygonal sides and a set of threads, a hard insulation sheath and a tip protruding from the sheath, the tool comprising in combination:

a tubular housing for receiving the spark plug;

internal polygonal sides formed in the housing for of the spark plug;

retaining means for releasably retaining the spark plug within the housing with the polygonal sides of the housing in engagement with the polygonal sides of the spark plug;

a flexible shaft;

a handle secured the shaft;

securing means for securing the lower end of the shaft to the housing, enabling a user to grasp the handle, insert the spark plug into the housing, insert the spark plug in the spark plug hole and rotate the spark plug with the handle to screw the spark plug into the spark plug hole, the securing means allowing the flexible shaft to be detached from the housing once the spark plug has been tightened by the flexible shaft; and a hole with polygonal sides formed in the upper end of the housing for receiving a torque member once the flexible shaft has been removed, for rotating the housing to further tighten the spark plug in the engine.

4. The tool according to claim 3 wherein the securing means comprises:

a threaded member joined to the shaft; and internal threads formed in the housing for receiving the threaded member, allowing the shaft to be detached from the housing by unscrewing the threaded member from the internal threads.

5. The tool according to claim 3 wherein the retaining means comprises an elastomeric liner located in the housing for frictionally gripping the insulation sheath.

6. The tool according to claim 3, further comprising: housing for receiving a wrench to rotate the housing.

* * * * *